United States Patent [19]

Sekine

[11] Patent Number: 4,968,587

[45] Date of Patent: Nov. 6, 1990

[54] METHOD FOR PRODUCING COLOR PRINT HAVING HIGH QUALITY AND LONG LIFE, APPLICABLE FOR LONG PERIOD CONSERVATION

[75] Inventor: Keiziro Sekine, Saitama, Japan

[73] Assignee: Kabushiki Kaisha Doi, Fukuoka, Japan

[21] Appl. No.: 178,303

[22] Filed: Apr. 6, 1988

[30] Foreign Application Priority Data

Aug. 5, 1987 [JP] Japan ..... 62-196064

[51] Int. Cl.[5] ..... G03C 7/04

[52] U.S. Cl. ..... 430/358; 430/359; 430/367; 430/391; 430/393

[58] Field of Search ..... 430/359, 367, 391, 393, 430/358

[56] References Cited

U.S. PATENT DOCUMENTS

| | | | |
|---|---|---|---|
| 2,099,916 | 11/1937 | Wilkinson | 430/359 |
| 2,183,598 | 12/1939 | Weaver | 430/359 |
| 3,022,164 | 2/1962 | Weir | 430/359 |
| 3,158,477 | 11/1964 | Vlahos | 430/359 |
| 3,329,501 | 7/1967 | Peaty | 430/359 |
| 3,337,343 | 8/1967 | Hove | 430/359 |
| 3,969,115 | 7/1976 | Savia | 430/358 |
| 4,837,133 | 6/1989 | Kuhn | 43/358 |

FOREIGN PATENT DOCUMENTS

| | | | |
|---|---|---|---|
| 476958 | 9/1951 | Canada | 430/358 |

*Primary Examiner*—Paul R. Michl
*Assistant Examiner*—Lee C. Wright
*Attorney, Agent, or Firm*—James C. Wray

[57] ABSTRACT

The method for producing color prints having high quality which are available for long-period conservation by using a color positive filter to make plural color separation negatives and black and white positives before printing through color filters on silver dye bleach film.

9 Claims, 2 Drawing Sheets

FIG. 1 SPECTRAL SENSITIVITY OF SDB PAPER
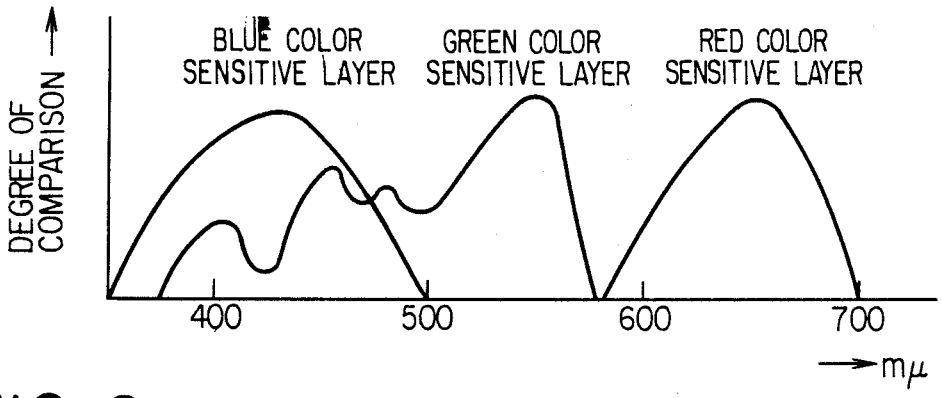
FIG. 2 PERMEABLE RATIO OF B-G-R FILTER
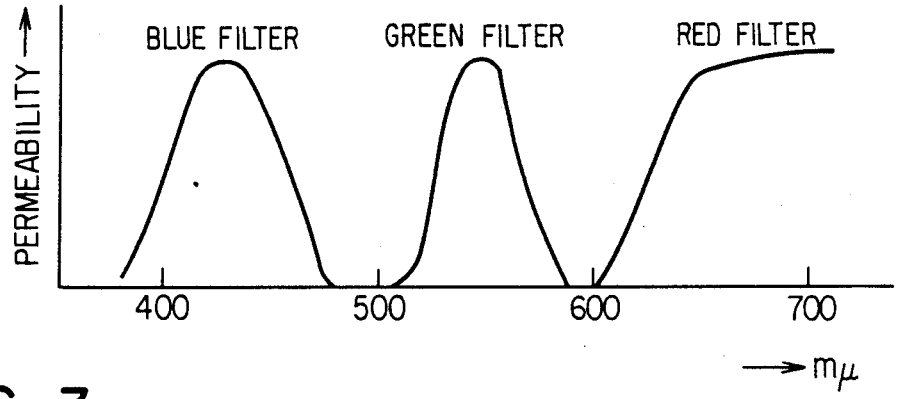
FIG. 3
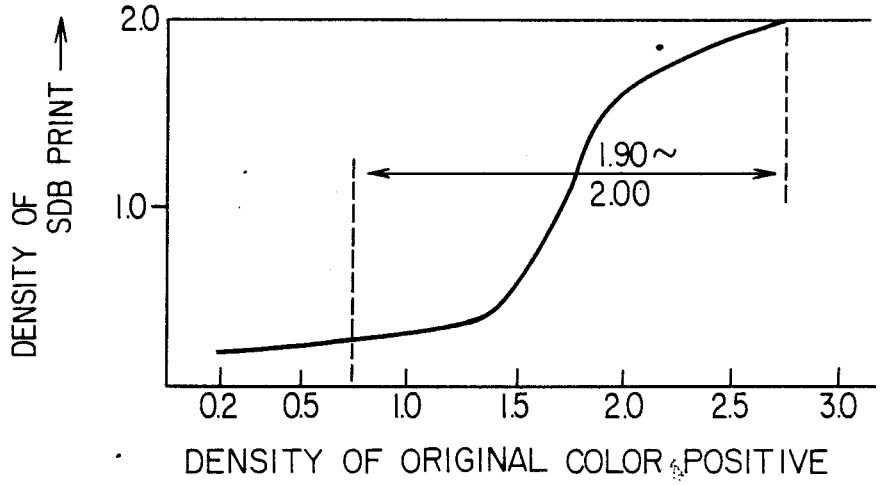

METHOD FOR PRODUCING COLOR PRINT HAVING HIGH QUALITY AND LONG LIFE, APPLICABLE FOR LONG PERIOD CONSERVATION

BACKGROUND OF THE INVENTION

The present invention relates to a method for producing color prints having high quality and long life which will be available for long periods of conservation.

U.S.A. and Europe, collections of color prints have recently spread, and color prints have been considered as art objects.

In order that color prints are recognized as art objects, the prints should have high quality and long life and should not discolor even during long periods of conservation.

In preparation of color prints, two methods may used: one of them is to use color photographic paper of nagative-positive type, and the other is to use color photographic paper of positive-positive type. As an example of the color photographic paper of positive-positive type, there is Ciba chrome paper, prepared by the silver dye bleach (SDB) process. This type of color photographic paper has great substantiality of color image in comparison with color prints obtained by color development. Therefore, positive-positive type photographic papers prepared by the silver dye bleach process have mainly been used to obtain high quality color prints as art objects. The color prints made under the silver dye bleach process, which was invented by K. Schizel in 1905, remarkably have been improved by successive progress and studies. Papers for such prints and prints made on the papers are now on the market as Ciba chrome paper (hereinafter referred to as "SDB paper" and "SDB print").

The color images of color prints on said SDB paper has outstanding durability in both dark and light discoloration in comparison with other color print materials. Consequently, SDB paper has been considered to be most suitable for color print material which is intended for long periods of conservation. However, in order that a color print is dealt with as an art object, the print should be superlative in its quality in addition to its durability of color.

Prints on the SDB paper now on the market may not necessarily fully satisfy the requirement. It can be said that the quality of color prints is almost always decided by the conscientious color and tone reproductions from the original color film. In this point, the SDB paper has still some defects in the above-said reproductions of color and tone. With respect to the tone characteristic, the tone characteristic becomes too high in contrast. As a result, there is too much contrast between high light portions and shadow portions of a print, and the definition of detail becomes worse. With respect to the color characteristic, there are such defects that light blue (C+M) tends to cyan and also light green (C+Y) tends to strong green of cyan; and further, gray at intermediated density becomes violet and light gray becomes cyan. These defects become obstacles in preparing color prints having high quality.

SUMMARY OF THE INVENTION

The object of the present invention is to solve the above-mentioned drawbacks and to provide a method for producing color prints which makes possible conscientious color and tone reproductions as well as the long life and long periods of conservation which are available in SDB prints.

The preferred method produces color prints having high quality and long life, which are available for long periods of conservation from an original color positive film. Preferably, one selects SDB paper made by silver dye bleach process. Then, one makes the original color positive film into three black and white separation negatives for Y, M, and C by using filters B, G, and R for three color separation and, at that time, reproducing the three color images possessed by the original color positive film to the black and white separation negatives as accurately as possible. Preferably, correction masks for color or tone are used in conformity with tone characteristics of the SDB paper, in the movement of the images into the black and white separation negatives. The images are coverted into black and white positive images by printing from the black and white separation negatives, using said black and white positive images as originals, and using narrow band B and G filters for Y and M positive films and using a sharp-cut R filter for C positive film.

Composite printing is done on the SDB paper. Thereafter, a predetermined development treatment is conducted.

A preferred method for producing color prints on silver dye bleach (SDB) paper includes making plural color separation black and white positives from a color positive film using plural color filters, and making a color print on SDB paper from the color separation positives using plural like color filters.

Preferably, the making of plural color separation black and white positives comprises the preliminary step of making plural color separation negatives with the first plural color filters. In a preferred embodiment, the making of plural color negatives comprises the preliminary steps of making plural density correction masks using density correction filters.

The preferred method for producing color prints on silver dye bleach (SDB) paper comprises making three color separation black and white positives from a color positive film using B, G and R color filters, and making a color print on SDB paper from the color separation positive using B, G, and R color filters. Preferably, the making of color separation black and white positives comprises the preliminary step of making color separation negatives with the first color filters.

Preferably, the making of color negatives comprises the preliminary steps of making C, M and Y density correction masks using density correction C, M and Y filters.

BRIEF DESCRIPTION OF THE DRAWINGS

FIG. 1 shows one example of curves of spectral sensitivity of SDB paper, which is used in the present invention.

FIG. 2 shows a curve line of spectral sensitivity of B, G, and R filters for color reproduction of SDB paper, which is used in the present invention.

FIG. 3 is a diagram of density range showing the relationship between the density range of an original positive film used in the present invention and the density range of SDB paper.

DETAILED DESCRIPTION OF THE DRAWINGS

Figure 4:
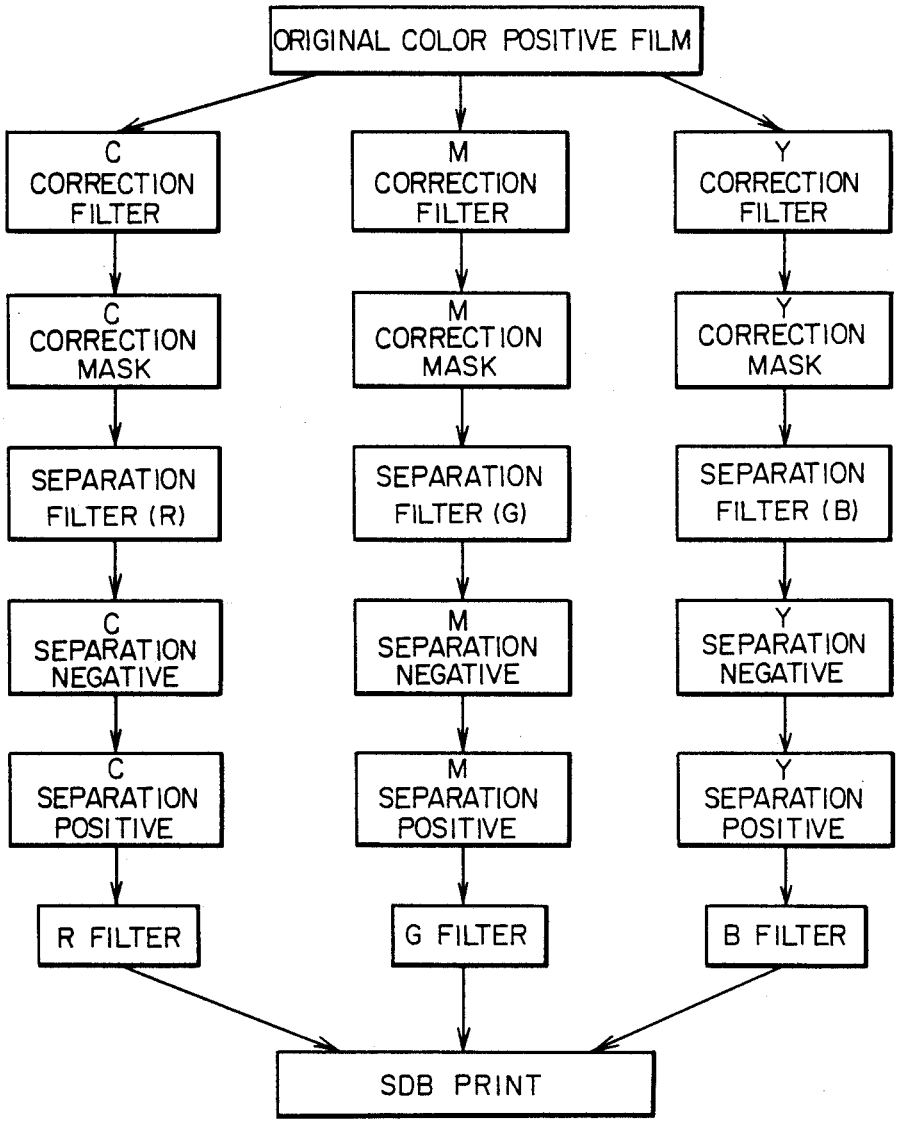
FIG. 4 is a diagram showing a method for producing color prints having high quality and capable of being conserved for long periods.

FIG. 1 is a diagram showing the measurement of spectral sensitivity of SDB paper. According to this figure, there is an overlapped point of light B and light G at wavelength of 370 to 500 um. This overlap of the both lights B and G is the cause of the defects of the above-mentioned color characteristic, i.e., blue tending to cyan and green also tending to cyan.

This defect can be overcome by three-time exposures with the use of three filters B, G, and R which have spectral characteristics as shown in FIG. 2.

Next, defects in reproduction of tone of SDB paper may be overcome. Color density in an original color positive film and color density of an SDB print are compared in FIG. 3. The density of a normal color positive film is about 0.30 at a high light portion and 2.80 to 3.00 at a shadow portion. However, the density range of positive film in which SDB paper can be effectively used for reproductions is about 1.90 to 2.00. Accordingly, when attempting to improve tone of high light portions of SDB print, detail of shadow portions becomes blackened and disappears and cannot be reproduced. On the other hand, when it is tried to improve the tone of the shadow portions, the details of high light portion cannot be reproduced and become pure white. Thus, the full reproduction of the original cannot be made. The solution to these defects is to produce duplicate color positive film in which the density range of an original color positive is made to be 1.90 to 2.00, which meets the some characteristic of SDB paper. However, to produce such a duplicate positive film, the density of which is changed to be 1.90 to 2.00 in a density range without losing the color of an original color positive, is almost impossible, when color sensitive materials on the present market are used.

In this connection, if three-time exposures are made by using the above-said B, G, and R filters, black and white positive films which are separated into three colors ought to be used, even though its original is not necessarely a color positive film. This is due to the reason that the manufacture of black and white positive film which is approximately separated into three colors is easier to produce than a duplicate which is conformed to the density range of SDB paper from the original positive film.

In manufacturing of color prints having high density by solving the above-mentioned problems of color characteristic and tone characteristic which SDB papers involve, the manufacturing of prints by three color separation is the best method. This is especially because the density range can be easily conformed with tone characteristic of SDB paper in a manufacturing process of each color of positive films of Y, M, and C which are separated into black and white respect to the reproduction of tones in print.

FIG. 4 shows steps for manufacturing SDB prints by the three color separation (exposure) method.

An original color positive film is separated into three colors of Y, M, and C by using separation filters of B, G, and R, thereby three black and white separation negatives. In this separation operation, correction masks for color and tone are prepared in order to make color images possessed by the original, i.e., Y image, M image and C image duplicated in each separation negative as accurately as possible and in order to conform to tone characteristic of Y, M, and C of the SDB paper, i.e., color balance, and the separation operation is carried out through these masks.

Next, as SDB paper is a reverse print sensitive material, it is necessary to convert these three separation negatives to separation positives. For this requirement, continuous tone black and white film which may be orthochromatic film or regular film is used. Three black and white positive images are prepared by printing the respective three separation negatives to said continuous tone black and white films. In this case, positive is at a density range of around 2.00 in accordance with tone characteristic of SDB paper. The density of separation negatives may be 1.20 to 1.40 in consideration of the characteristic of separation film.

The printing to SDB paper is conducted from thus prepared separation positive film. That is, for a positive film for Y image, a blue filter fo narrow band as shown in FIG. 2 is used. For a positive film for M image, a green filter of narrow band as shown in FIG. 2 is used. For a positive film for C image, a sharp cut red filter is used. By so adjusting the aim that the three images do not slip out of position, combined printing is conducted on one sheet of SDB paper. When, after the printing, a designated development treatment is conducted, color prints having high quality and high fidelity can be obtained.

The technology of the method for producing color prints according to the present invention makes it possible to change color and tone to a certain extent from an original color positive. Further, such changes of color and tone that photographers require can be done by selecting separating filters having variously different permeable characteristics at the time of three color separation or changing masks for color corrections and tone corrections.

While the invention has been described with reference to specific embodiments, modifications and variations of the invention may be constructed without departing from the scope of the invention. The scope of the invention is defined in the following claims.

I claim:

1. The method for producing color prints on silver dye bleach (SDB) paper comprising, making plural color separation black and white pasitives from a color positive film using plural color filters, and making a color print on SDB paper from the color separation positives using plural like color filters, wherein the making of plural color separation black and white positives comprises the preliminary step of making plural color separation negatives with the first plural color filters, wherein the making of plural color negatives comprises the preliminary steps of making plural density correction masks using density correction filters.

2. The method for producing color prints on silver dye bleach (SDB) paper comprising, making three color separation black and white positives from a color positive film using blue, green and red color filters, and making a color print on SDB paper from the color separation positives using blue, green and red color filters, wherein the making of color separation black and white positive comprises the preliminary step of making color separation negatives with the first color filters, wherein the making of color negatives comprises the preliminary steps of making cyan, magenta and yellow density correction masks using density correction cyan, magenta and yellow filters.

3. A method for producing color print on a silver dye bleach paper from a color positive film having a reproducing density range which is greater than that of the silver dye bleach paper, comprising the steps of:

making three color separation black and white negative from the color positive film by using blue, green and red color filters for yellow, magenta and cyan separations, respectively;

making three color separation black and white positives from the negatives, respectively, each of the positives having an effective reproducible density range in which adequate tone balances of images can be ensured and which is substantially equal to the reproducible density range of the silver dye bleach paper; and making a composite color print on the silver dye bleach paper from the positives by using blue, green and red color filters, respectively, wherein the making of the negatives comprises masking of the negatives with color and tone correction masks for both the correction of density balances of color contents of images to be formed on the negatives and the correction of deviations of tone balances of images to be formed thereon.

4. A method for producing color prints on silver dye bleach (SDB) paper comprising the following steps:

making plural density correction masks using density correction color filters;

making plural color separation black and white negatives using plural color filters and the correction masks;

making plural color separation black and white positives from the negatives; and making a color print on SDB paper from the color separation positives using the same plural color filters as in the second step.

5. The method of claim 4, wherein the making of density correction masks comprises making cyan, magenta and yellow density correction masks using density correction cyan, magenta and yellow filters.

6. The method of claim 4, wherein the making of the color separation black and white negatives comprises using blue, green and red color filters.

7. The method of claim 6, wherein the cyan density correction masks is used with the red color filter to make the cyan separation black and white negative, the magenta density correction masks is used with the green color filter to make the magenta separation black and white negative, and the yellow density correction masks is used with the blue color filter to make a yellow separation black and white negative.

8. The method of claim 6, wherein a cyan separation black and white positive is made from the cyan separation black and white negative, a magenta separation black and white positive is made from the magenta separation black and white negative, and a yellow separation black and white positive is made from the yellow separation negative.

9. The method of claim 8, wherein a red color filter is used with the cyan separation black and white positive, a green color filter is used with the magenta separation black and white positive, and the blue color filter is used with the yellow separation black and white positive to make the color print on silver dye bleach paper.

* * * * *